US005833635A

United States Patent [19]

Aboud, Sr.

[11] Patent Number: 5,833,635

[45] Date of Patent: Nov. 10, 1998

[54] COMBINATION BACK SCRATCHER AND BODY MASSAGER

[76] Inventor: George Moses Aboud, Sr., 3939 E. Glenrosa Ave., Phoenix, Ariz. 85018-4808

[21] Appl. No.: 893,418

[22] Filed: Jul. 11, 1997

[51] Int. Cl.[6] ..... A61H 7/00

[52] U.S. Cl. ..... 601/136; 601/137; 601/122; 601/128; 601/118; 601/119

[58] Field of Search ..... 601/134, 135, 601/136, 137, 138, 144, 145, 118, 119, 122, 128, 129; 132/107, 126, 129

[56] References Cited

U.S. PATENT DOCUMENTS

| | | | |
|---|---|---|---|
| D. 260,694 | 9/1981 | Mallett . | |
| D. 266,280 | 9/1982 | Toyama . | |
| D. 277,512 | 2/1985 | Colognori . | |
| D. 280,448 | 9/1985 | Colognori . | |
| D. 280,449 | 9/1985 | Colognori . | |
| D. 282,007 | 12/1985 | McKinney . | |
| D. 282,689 | 2/1986 | McCormick . | |
| D. 311,605 | 10/1990 | Clayton . | |
| D. 312,145 | 11/1990 | Murphy . | |
| D. 330,094 | 10/1992 | Chmura, Jr. . | |
| D. 356,399 | 3/1995 | Spiwak . | |
| D. 369,439 | 4/1996 | Fischer . | |
| 1,586,031 | 5/1926 | Duncan | 601/137 |
| 1,987,390 | 1/1935 | Davis | 601/137 |
| 2,516,491 | 7/1950 | Swastek | 601/137 |
| 2,601,858 | 7/1952 | Ackerman | 132/129 |
| 3,368,554 | 2/1968 | Chou | 601/137 |
| 4,071,021 | 1/1978 | Gallacci . | |
| 4,091,805 | 5/1978 | Clark . | |
| 4,414,992 | 11/1983 | Russell | 132/129 |
| 4,574,788 | 3/1986 | Jordan . | |
| 4,915,096 | 4/1990 | Winstone et al. . | |
| 5,285,774 | 2/1994 | Stachurski | 132/129 |

FOREIGN PATENT DOCUMENTS

| | | | |
|---|---|---|---|
| 2341440 | 2/1975 | Germany | 601/137 |

*Primary Examiner*—Richard J. Apley
*Assistant Examiner*—Benjamin Kao

[57] ABSTRACT

A skin stimulator which has a number of handles around the periphery of a generally circular base. Opposite each handle and on an opposing edge of the base member, are teeth or stimulators which are used to stimulate the skin (i.e. back, soles, or legs) of a user. A mounting bracket permits the stimulator to be mounted onto a wall, a door, or a floor stand. The preferred mounting bracket is created by a series of radially extending channels which allow the user to readily adjust the stimulator so that a particular set of unique teeth are accessible. In one embodiment of the floor stand, a vibrator is used to vibrate the stimulator so that the soles of a user's feet are massaged and stimulated. In one embodiment of the invention, each handle is provided with a tactile indicia so that the user is able to identify the teeth which will be used by merely grasping the handle portion. Teeth, in this context, include: pointed protrusions, rounded protrusions, rollers, and rolling balls.

18 Claims, 3 Drawing Sheets

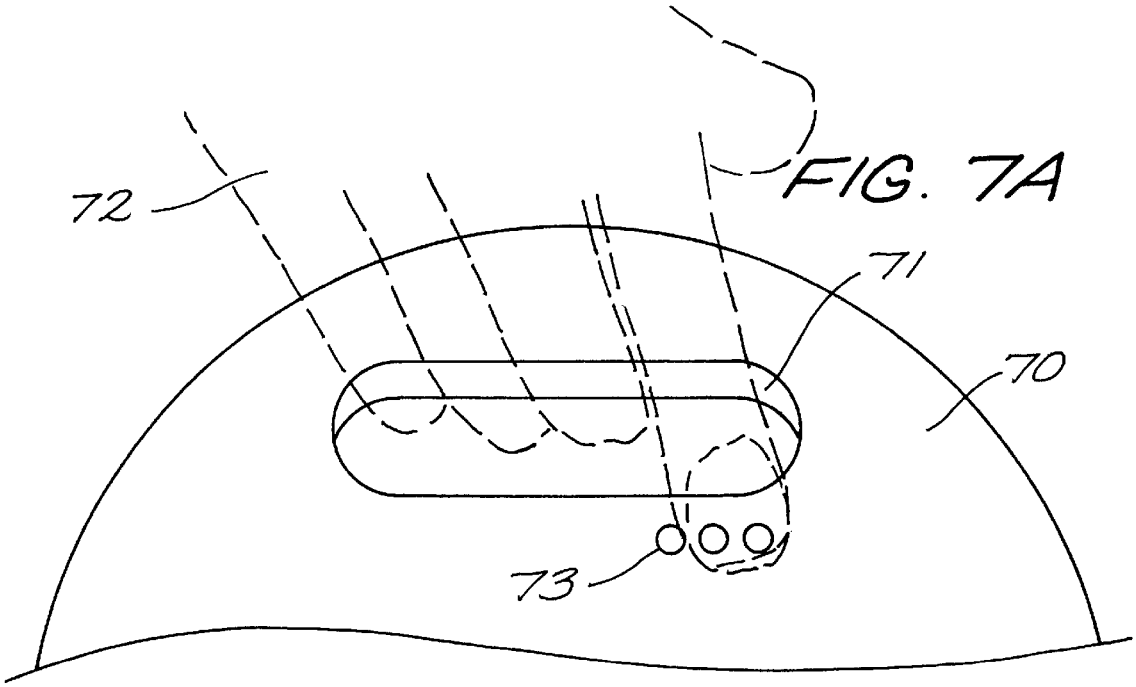
FIG. 7A
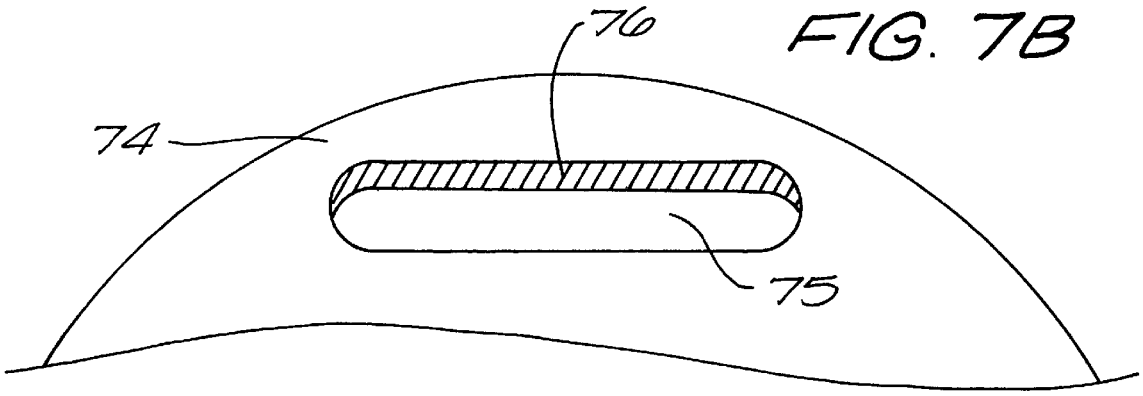
FIG. 7B
FIG. 8
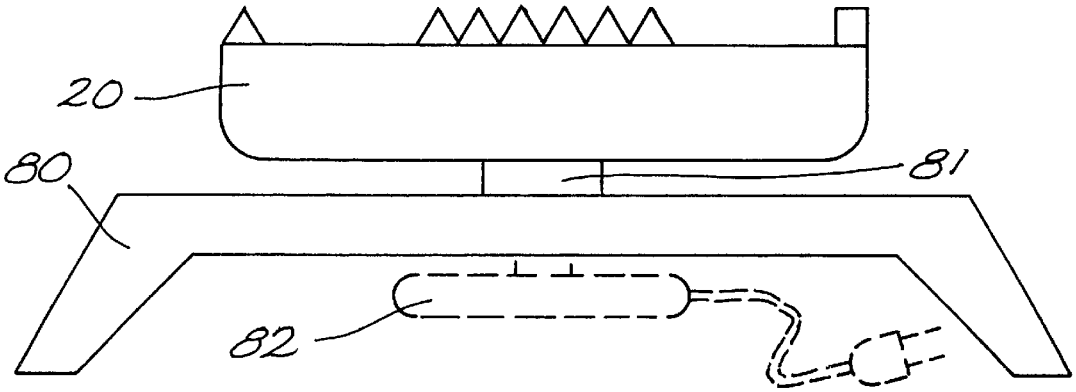

COMBINATION BACK SCRATCHER AND BODY MASSAGER

BACKGROUND OF THE INVENTION

This invention relates generally to back-scratchers and body massagers and more particularly to such apparatus which are manually powered A great many skin stimulators (commonly called "back-scratchers") have been developed to assist humans in stimulating their own skin in places which are difficult to reach either due to location (i.e. the middle of the back) or due to physical limitations of the user (i.e. severe arthritis).

These attempts are exemplified by U.S. Pat. DES 312,145, entitled "Back Scratcher" issued to Murphy on Nov. 13, 1990. This patent shows a simple apparatus having a handle and a bar which is adapted to scratch "hard to reach" areas.

Other attempts have provided highly stylized scratchers, such as U.S. Pat. DES 356,399, entitled "Back Scratcher" issued to Spiwak on Mar. 14, 1995.

While these attempts have provided rudimentary solutions, a versatile apparatus which provides the user with a variety of levels of "scratching" does not exist.

It is clear that there is a need for an improved apparatus which assists the user in scratching and massaging their own body.

SUMMARY OF THE INVENTION

It is the primary objective of the present invention to provide a device that serves as a back scratcher and body massager that provides greater effectiveness and comfort while at the same time facilitating its use by handicap persons having a limited range of arm motion.

It is another objective of the present invention to provide four different degrees of stimulation and to provide massaging of the back and foot areas.

It is another objective of the present invention to offer a back scratcher and massager as a wall or door mounted apparatus which is then usable without the user's hands.

It is another objective of the present invention to offer a foot scratcher and massager as a floor mount requiring no use of the hand or hands.

The present invention creates a skin stimulator which has a number of handles around the periphery of a generally circular base. The handles permit the user to easily grasp and manipulate the skin stimulator in order to select the degree of "scratchiness" the user desires.

In the preferred embodiment, the entire assembly is manufactured from plastic or other material so that the total weight is reduced. In some embodiments, the skin stimulator is manufactured from wood.

In the preferred embodiment, the base member is approximately sixteen inches across.

Opposite each handle and on an opposing side of the base member, are teeth or stimulators which are used to stimulate the skin (i.e. back, soles, or legs) of a user. The positioning of the teeth opposite a single handle allows the user to select a particular handle, and in so doing, define which set of teeth will be positioned to address the skin.

In the preferred embodiment, each set of teeth has unique characteristics relative to the other sets of teeth. As example, some sets of teeth may be sharper than other sets, the teeth may be more densely packed, the teeth may be rounded, the teeth may be mounted onto a roller, or the teeth may constitute a series of roller balls.

In use, the handle which the user selects also defines the type of teeth which will be utilized.

In the preferred embodiment, a mounting bracket permits the stimulator to be mounted onto a wall or a floor stand. In some applications, the user is unable, or does not want to use manual means to apply the skin stimulator to a particular body part. In this situation, the mounting bracket allows the skin stimulator to be secured to a "fixed" object and then allow the user to move their body against the stimulator.

The preferred mounting bracket is created by a series of radially extending channels which allow the user to readily adjust the stimulator so that a particular set of unique teeth are accessible. A simple screw or other protrusion extending through the channels allows the user to rotate the skin stimulator so that the desired teeth are positioned properly for the user to press the selected body part (i.e. the back or the soles of the feet) against the teeth having the chosen characteristics.

In one embodiment of the floor stand, a vibrator is used to vibrate the stimulator so that the soles of a user's feet are massaged and stimulated. In one embodiment employing the floor stand and vibrator, the vibrator is secured to the floor stand and then connected to the mounting bracket so that the vibrations are transmitted to the skin stimulator.

Another aspect of the present provides each handle with a unique tactile indicia so that the user is able to identify the set of teeth which will be used by merely grasping the handle portion. This attribute permits the user to grasp a handle, without looking at it, and to recognize which teeth are to be applied. This feature is particularly useful for the blind or where the user's vision is handicapped.

Tactile indicia include a variety of forms including: protrusions (bumps) which are near the handle so that the user is able to touch the protrusions with their index finger while holding the handle; and, unique texturing around the handle itself.

Teeth, in this context, include: pointed protrusions, rounded protrusions, rollers, and rolling balls. In one embodiment of the invention, a single rotating "tube" is used.

This tube includes protrusions which, as the user causes the tube to rotate, provide a massaging action against the skin.

The invention creates a combination back scratcher and body massager. The preferred embodiment uses four handles and four sets of teeth. The apparatus is in the form of a circular device having hand holds every 90 degrees and opposite these hand holds is a set of teeth with varying degrees of "scratchiness".

When this device is being used, automatically the body part being treated is also being massaged at the same time.

The invention, together with various embodiments thereof, will be more fully explained by the accompanying drawings and the following description.

DRAWINGS IN BRIEF

FIGS. 7A and 7B are alternative embodiments illustrating tactile indicia associated with handles of the present invention.

FIG. 8 is a side view of an embodiment of the invention adapted to massage the soles of a user's feet.

DRAWINGS IN DETAIL

Figure 1:
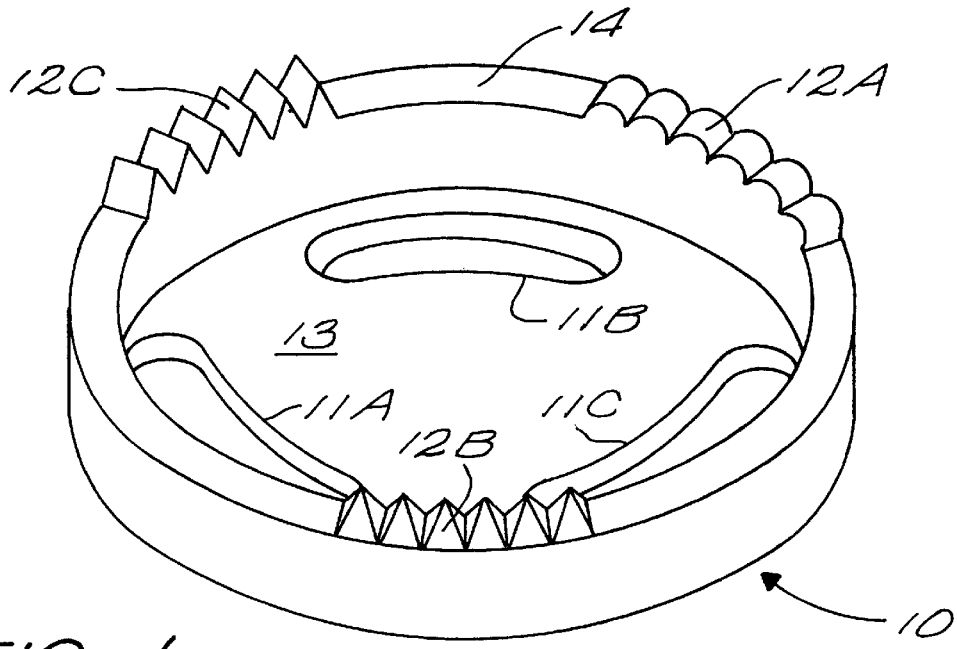
FIG. 1 is a perspective view of an embodiment of the invention.

FIG. 1 is a perspective view of an embodiment of the invention.

Stimulator (back-scratcher and massager) 10 of this embodiment has a base member 13 with wall 14 extending around its circular periphery. Located on wall 14 are various teeth arrangements (three in number) 12A, 12B, and 12C.

Handles 11A, 11B, and 11C, are formed in base member 13 near the periphery and opposite one of the teeth arrangements. As shown: handle 11A is opposite teeth 12A; handle 11B is opposite teeth 12B; handle 11C is opposite teeth 12C. In this manner, the user, by selecting which handle to grasp, also selects the teeth which are to be used to stimulate the skin.

Note that teeth 12A, 12B, and 12C have differing characteristics allowing the user to select that which is appropriate for the immediate situation.

In the preferred embodiment, base member 13 is approximately sixteen inches in diameter.

Figure 2:
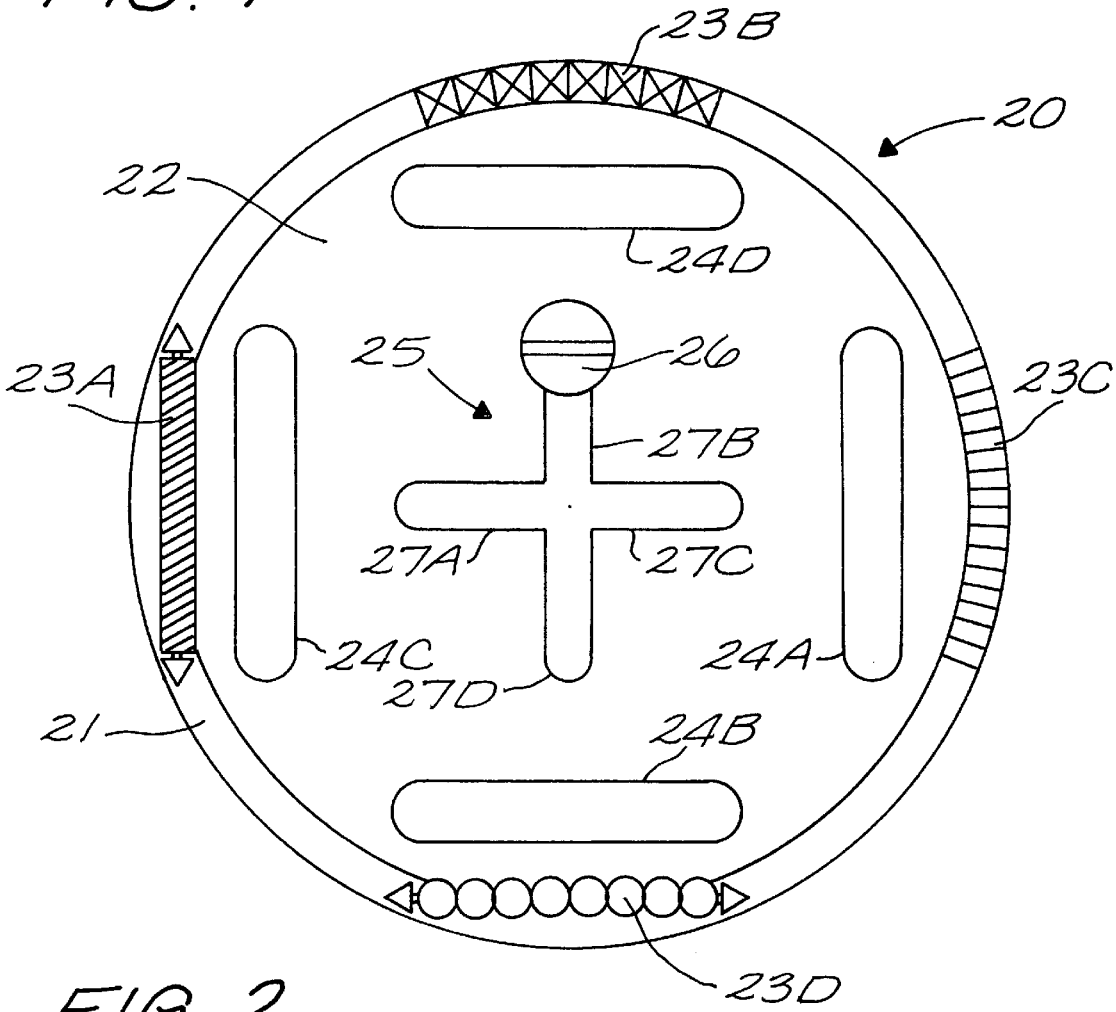
FIG. 2 is a top view of the preferred embodiment of the invention.

FIG. 2 is a top view of the preferred embodiment of the invention.

Stimulator 20 has a base member 22 with wall member 21 extending therefrom. Teeth/stimulators 23A, 23B, 23C, and 23D are positioned on the top of wall member 21. Handles 24A, 24B, 24C, and 24D are positioned opposing a single set of teeth.

This embodiment is adapted to be mounted onto a "fixed" object such as a wall, a door, or a frame placed upon the floor. The mounting mechanism 25 of this embodiment is a series of radially extending channels 27A, 27B, 27C,and 27D. Each channel extends through base member 22 and is positioned to be substantially perpendicular to one of the sets of teeth. As example, channel 27D is perpendicular to teeth 23D.

Screw 26 is used to affix stimulator 20 to a fixed object. Screw 26 is not snugged against base member 22; thereby allowing the base member to be manually moved so that any of the teeth can be placed in the upper most position. In this illustration screw 26 is positioned along channel 27B so that teeth 23B are uppermost as the stimulator hangs on a door. Teeth 23B are then properly positioned for the user to utilize in scratching the user's back.

If the user wants a different set of teeth, a simple movement of the stimulator relative to the fixed screw 26 allows the user to select any channel, and by extension, any set of teeth.

Figure 3A:
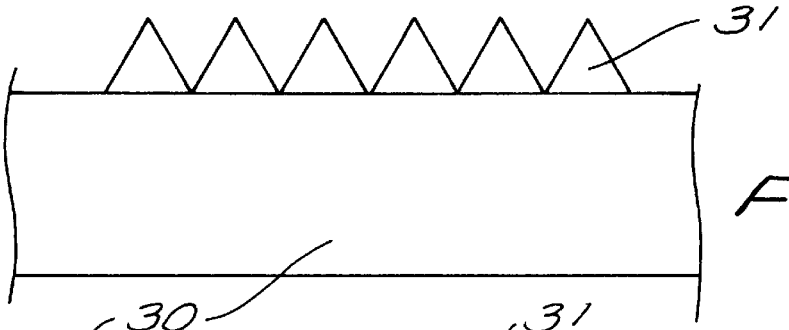
FIGS. 3A and 3B are side and top views of an embodiment of the teeth used in the present invention.
Figure 3B:
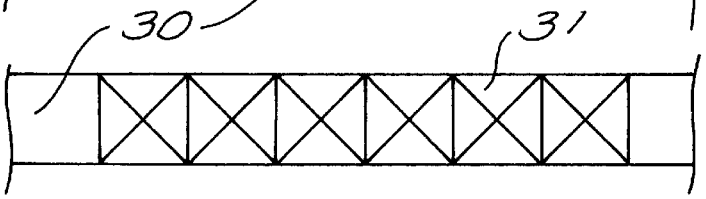

FIGS. 3A and 3B are side and top views of an embodiment of the teeth used in the present invention.

In the preferred embodiment, at least two sets of teeth are mounted onto the stimulator. Preferably, these teeth have differing characteristics. The teeth 31 of FIG. 3A and 3B are mounted onto wall member 30 and are shaped to have pointed ends.

Figure 4A:
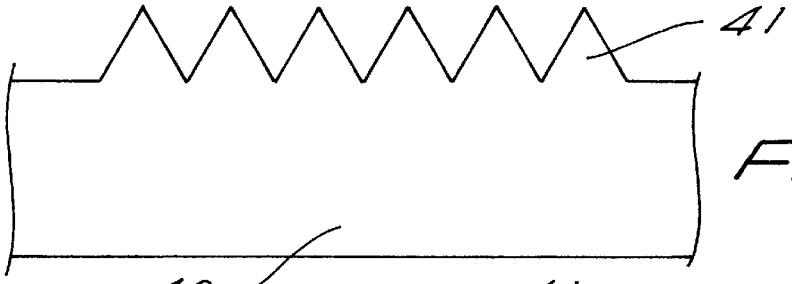
FIGS. 4A and 4B are side and top view of an embodiment of the teeth used in the present invention.
Figure 4B:
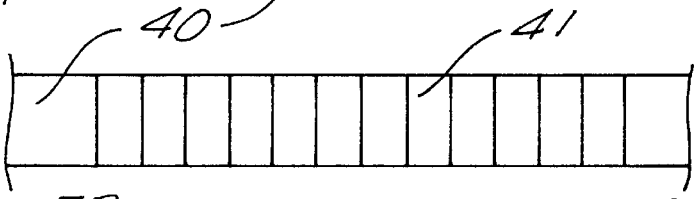

In comparison, teeth 41 of FIGS. 4A and 4B are also mounted on a wall 40 but are not pointed but have an extended ridge across the entirety of the wall's width.

Through selection of the teeth's width and structure, an assortment of teeth is readily obtained. This assortment permits the user to select that which feels the best.

Figure 5:
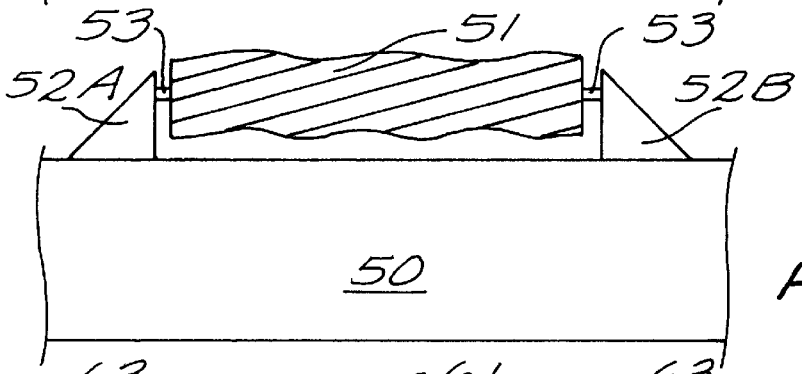
FIG. 5 is a side view of a roller used as teeth for the present invention.

FIG. 5 is a side view of a roller used as teeth for the present invention.

Within the context of this invention, the term "teeth" is meant to include a wide variety of mechanisms which are adapted to scratch or massage the user. FIG. 5 illustrates the use of roller 51 which has been mounted on wall 50 using brackets 52A and 52B and supported by axle 53.

Roller 51, in this embodiment, is irregularly shaped creating protrusions which assist in the massaging of the user's skin. This embodiment of the teeth is extremely beneficial for massaging the bottom of a user's feet.

Figure 6:
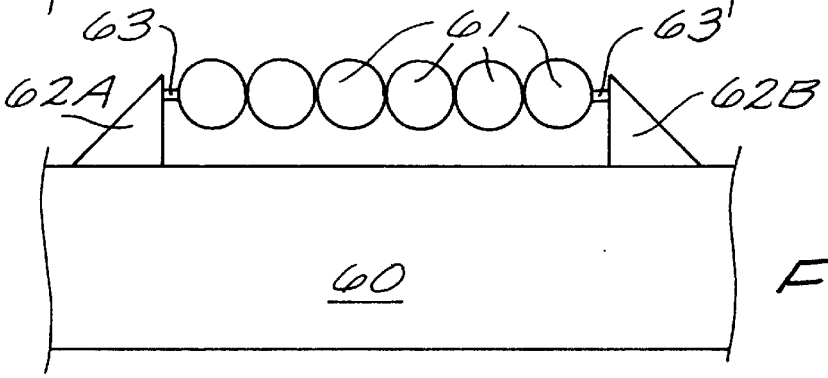
FIG. 6 is a side view of a series of ball massagers used as teeth for the present invention.

FIG. 6 is a side view of a series of ball massagers used as teeth for the present invention.

In a similar manner to that discussed relative to FIG. 5, balls 61 are rotatably suspended on axle 63 held in position by brackets 62A and 62B on wall 60. When balls 61 are pressed and moved against the skin, they "roll" causing the skin to be massaged.

FIGS. 7A and 7B are alternative embodiments illustrating tactile indicia associated with handles of the present invention.

Stimulator 70 is gripped by user 72 at handle 71. To identify which handle is being gripped, this embodiment of the invention places tactile indicia 73, a series of bumps, so that the user is able to "read" the tactile indicia with their index finger.

The tactile indicia 73 is unique to handle 71 as the other handles on stimulator 70 (not shown) each have their own unique tactile indicia. This arrangement allows the user to move to a new handle, without looking, and know which teeth are associated with the handle.

In a similar manner, FIG. 7B provides for a tactile indicia for stimulator 74 by providing a "texturing" 76 of handle 75. In this illustration, the degree of "roughness" in texturing 76 gives the use the tactile feed-back on which handle is being grasped.

FIG. 8 is a side view of an embodiment of the invention adapted to massage the soles and between the toes of a user's feet.

Stimulator 20, described in FIG. 2, has been mounted via bracket 81 onto floor mount 80. Floor mount 80 is designed to permit the user ready access to the teeth to massage or scratch the soles and toes of the user's feet.

In one embodiment of the invention, vibrating motor 82 is also included which causes stimulator 20 to vibrate, thereby creating further massaging affect.

It is clear that the present invention creates a highly improved and versatile stimulator which both massages and scratches the user's skin.

What is claimed is:

1. An apparatus for stimulating the skin of user comprising:

a) a generally circular base member having at least two handles positioned proximate to a periphery of said generally circular base member; and, b) a wall member extending around the periphery of said generally circular base member and substantially perpendicular to said generally circular base member, said wall member having at least two sets of teeth positioned on an exposed edge of said wall member and opposite one of said at least two handles in said generally circular base member, said generally circular base member having a set of interconnected channels extending through said generally circular base member, each of said channels extending substantially perpendicular to one of said sets of teeth.

2. The apparatus according to claim 1, further including a floor member having:

a) a stand member adapted to be placed upon a floor; and, b) connector means for securing said stand member to said generally circular base member via said means for mounting.

3. The apparatus according to claim 2, further including means for vibrating said connector member, said means for vibrating attached to said stand member.

4. The apparatus according to claim 1, further including:

a) a roller having teeth thereon and having a generally circular cross section and an interior channel; and, b) axle means for supporting said roller in relationship to said wall member via said interior channel such that said roller is adapted to freely rotate.

5. The apparatus according to claim 4 wherein said roller has a series of protrusions extending therefrom.

6. The apparatus according to claim 4 wherein said roller includes a series of balls.

7. The apparatus according to claim 1, wherein each of said at least two handles include a unique tactile indicia.

8. The apparatus according to claim 7, wherein said tactile indicia includes a series of bumps positioned to be felt by an index finger of user.

9. The apparatus according to claim 7, wherein said tactile indicia includes a texturing of the handle.

10. The apparatus according to claim 1, a) wherein said at least two handles are four handles positioned equal distance around the periphery of said generally circular base member; and, b) wherein said at least two sets of teeth are four sets of teeth.

11. The apparatus according to claim 10, wherein said base member has a diameter of approximately sixteen inches.

12. A skin stimulator comprising:

a) a base member having at least two handles positioned proximate to a periphery thereof;

b) at least two sets of teeth extending substantially perpendicular to said base member, each of said sets of teeth associated with one of said at least two handles; and, c) a set of interconnected channels radially extending from a center point of said base member and perpendicular to one of said sets of teeth.

13. The skin stimulator according to claim 12, further including a floor member having:

a) a stand member adapted to be placed upon a floor; and, b) connector means for securing said stand member to said base member.

14. The skin stimulator according to claim 12, wherein each of said at least two handles include a unique tactile indicia.

15. An back-scratcher comprising:

a) a circular base member having four handles positioned equal distance around a periphery of said base member;

b) four sets of teeth extending substantially perpendicular to said base member, each of said sets of teeth positioned opposite one of said four handles and, c) means for mounting said back-scratcher to another surface, said means for mounting including a set of interconnected channels through said base member such that each of said channels extends substantially perpendicular to one of said sets of teeth.

16. The back-scratcher according to claim 15, further including a floor member having:

a) a stand member adapted to be placed upon a floor; and, b) connector means for securing said stand member to said base member via said means for mounting.

17. The back-scratcher according to claim 16, wherein said stand member is substantially larger than said base member.

18. The back-scratcher according to claim 16 wherein each of said four sets of teeth are unique in shape.

* * * * *